US005686049A

United States Patent [19]

Bonifay et al.

[11] Patent Number: 5,686,049

[45] Date of Patent: Nov. 11, 1997

[54] HEAT EXCHANGE APPARATUS FOR SOLID PARTICLES FOR DOUBLE REGENERATION IN CATALYTIC CRACKING

[75] Inventors: Regis Bonifay, Asnieres; Frederic Hoffmann, Paris; Renaud Pontier, Vienne; Thierry Gauthier, Saint Genis Laval, all of France

[73] Assignee: Institut Francais Du Petrole, Rueil Malmaison, France

[21] Appl. No.: 539,667

[22] Filed: Oct. 5, 1995

Related U.S. Application Data

[60] Continuation of Ser. No. 206,697, Mar. 7, 1994, abandoned, which is a division of Ser. No. 976,044, Nov. 13, 1992, Pat. No. 5,324,696.

[30] Foreign Application Priority Data

Nov. 14, 1991 [FR] France ..... 91/14.153

[51] Int. Cl.[6] ..... F27B 15/08

[52] U.S. Cl. ..... 422/144; 422/145; 422/146; 422/147

[58] Field of Search ..... 422/144–147, 422/201, 223; 502/41–44; 208/164

[56] References Cited

U.S. PATENT DOCUMENTS

| | | | |
|---|---|---|---|
| 2,735,802 | 2/1956 | Jahnig | 196/52 |
| 4,434,245 | 2/1984 | Lomas et al. | 502/2 |
| 4,595,567 | 6/1986 | Hedrick | 422/146 |
| 4,614,726 | 9/1986 | Walters et al. | 502/41 |
| 4,615,992 | 10/1986 | Murphy | 502/41 |
| 4,923,834 | 5/1990 | Lomas | 502/41 |
| 4,965,232 | 10/1990 | Mauleon et al. | 502/43 |
| 5,120,691 | 6/1992 | Pontier et al. | 502/44 |
| 5,212,129 | 5/1993 | Lomas | 502/43 |

FOREIGN PATENT DOCUMENTS 2 628 342 9/1989 France .

*Primary Examiner*—Christopher Kim

*Attorney, Agent, or Firm*—Millen, White, Zelano, & Branigan, P.C.

[57] ABSTRACT

A catalyst, e.g., a cracking catalyst, and a part of the regeneration fumes are drawn off from the dense catalytic bed of a second regenerator (9) and are introduced by force of gravity into an external exchanger (21) at a junction point beneath the level of the dense bed of the second regenerator. The heat exchange takes place in the bottom part of the exchanger below the junction point. Between the bottom end of the exchanger and the region above the junction point a dense bed zone is formed at a level which is substantially at the height of the dense bed in the regenerator and a discharge zone (27), of suitable size, for the regeneration gases and fluidization gas. The gases and fumes from the exchanger are removed in the diluted fluidized phase from the second regenerator through a conduit (28), while the catalyst is recycled into the bed of the first regenerator through a conduit (34).

17 Claims, 1 Drawing Sheet

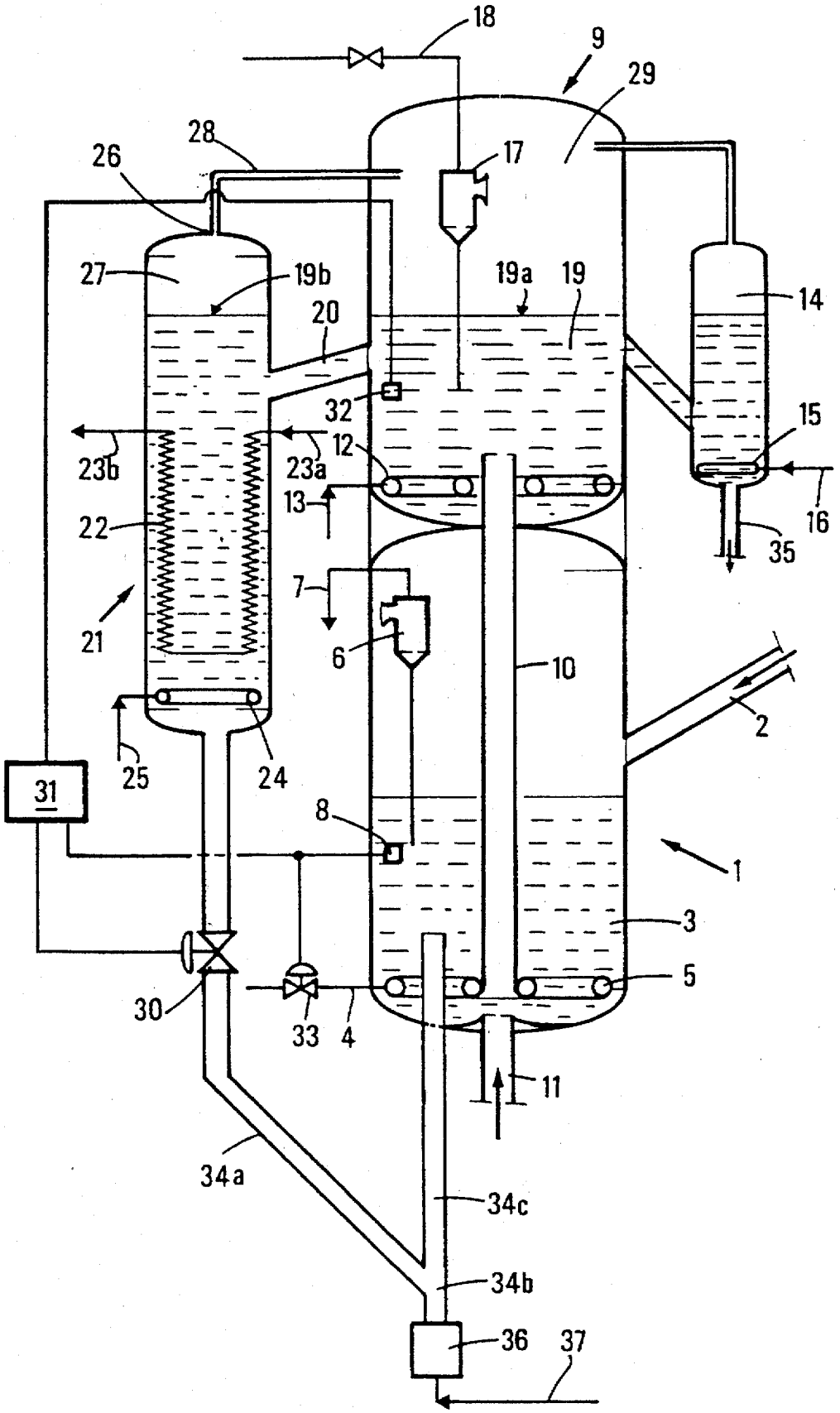
18
9
29
28
26
17
27
19b
19a
19
14
20
32
15
12
23b
23a
13
16
22
35
7
21
6
10
2
25
24
31
8
1
3
5
30
33
4
11
34a
34c
34b
36
37

HEAT EXCHANGE APPARATUS FOR SOLID PARTICLES FOR DOUBLE REGENERATION IN CATALYTIC CRACKING

This application is a continuation of application Ser. No. 08/206,697, filed Mar. 7, 1994, now abandoned, which is a divisional of application Ser. No. 07/976,044, filed Nov. 13, 1992, which issued as U.S. Pat. No. 5,324,696 on Jun. 28, 1994.

FIELD OF THE INVENTION

The invention relates to a process for the regeneration of a spent catalyst, with heat exchange in fluidized bed, and an apparatus for implementation of this process. More particularly, the process can be applied to the regeneration of catalysts which are in particular charged with hydrocarbon residues and coke after they have reacted with a hydrocarbon charge. The invention can relate to hydro-treatment, hydro-cracking or catalytic cracking catalysts, reshaping catalysts or even any contact mass, for example, used in thermal cracking processes.

As a purely illustrative example, the process will be applied to the regeneration of a spent catalyst from a catalytic cracking process, in fluidized bed, of heavy charges with a high Conradson carbon, such as an atmospheric residue, a residue under vacuum, or a non-asphalt containing residue, these residues being able to be hydro-treated.

The process is used, in particular, for temperature control.

BACKGROUND OF THE INVENTION

Catalytic cracking processes convert hydrocarbon charges into lighter products such as gasolines. To begin with, the charges are quite light like gas oils, for example, and in order to obtain a maximum conversion efficiency from the very active zeolite catalysts it is necessary to draw off the maximum amount of coke deposited on the catalysts which rendered them less active during a regeneration stage at a temperature of between 520° and 800° C.

Due to the pressing need for fuels, those within the refining industry have become interested in increasingly heavy charges comprising hydrocarbons with a high boiling point, such as a boiling point which is above 550° C., for example, and with a high Conradson carbon or a significant metal concentration. A large amount of coke and hydrocarbons can thus become deposited on the catalyst during the catalytic cracking phase, and regeneration of the catalyst by combustion can cause significant heat discharge which can adversely affect the apparatus and render the catalyst inactive, particularly during lengthy exposure to temperatures above 800° C. Controlled regeneration of the catalyst is therefore imperative. The problem occurs in particular when a process involving a technique in existence for a long time which basically treats conventional hydrocarbon charges is used for much heavier charges.

One of the aims of the invention is therefore to propose a regeneration process and apparatus with controlled cooling of the catalyst in a catalytic cracking unit with a view to treating heavy charges.

Another object of the invention is to make an apparatus easier to use.

The prior art is illustrated by the following patents:

U.S. Pat. No. 4,614,726 discloses an apparatus which has a regenerator, wherein the regeneration temperature is controlled by an external heat exchanger with descending flow through a bundle of tubes.

The cooled catalyst is recycled to the regenerator through a conduit for circulating the catalyst upwardly in the fluidized state, in the dense bed of this regenerator. The catalyst in the exchanger is kept in the dense bed by a fluidization gas which flows counter-currently to the direction of flow of the catalyst, and fluidization gas is either entrained with it when flow is very weak, or is removed via the intake line for the catalyst. This counter-current circulation of the gas disrupts flow of the catalyst in the intake tube and in the exchanger, and the heat exchange is not at a maximum.

U.S. Pat. No. 4,434,254 discloses a regenerator on two levels, comprising an external exchanger with lateral intake of the hot catalyst coming from the upper level which is a storage zone.

The cooled catalyst is recycled through a conduit, which receives regeneration air and the used up catalyst, in a zone at the lower level where combustion takes place. Therefore, functioning of the regenerator and of the exchanger are closely connected since the return of the cooled catalyst to the regenerator is dependent on the flow of fluidization air used for regeneration and which circulates in said conduit. This patent also discloses a small tube above the exchanger which opens into the dense bed of the exchanger in such a way that discharge of the gas and fumes cannot be complete in view of the presence of the catalyst in this tube. The catalyst circulation with backmixing phenomenon can then appear. Discharge of the gas deteriorates as the exchange bundle meets the upper end of the exchanger. The mixture does not have to be homogeneous, and therefore an upper zone exists where the catalyst stagnates and where it is not properly regenerated. This means that heat exchange is reduced.

U.S. Pat. No. 4,923,834 discloses a "backmixing" process where an upper tube opening into the intake conduit into the catalyst exchanger which circulates in dense bed enables the catalyst to be returned from the exchanger into the storage chamber of the regenerator. This patent is therefore concerned with cooling by "backmixing" and not with a solution to a problem connected with the removal from a heat exchanger of fumes and fluidization air permitting optimization of the heat exchange operation.

Finally, the prior art is illustrated by the French Patent (U.S. Pat. No. 4,965,232) which discloses an external system for cooling the catalyst in a unit comprising a double regeneration of the catalyst providing for a catalytic cracking apparatus, the two regenerators providing for separate removal of the combustion effluents, the catalyst circulating from the second regenerator to the first via the heat exchanger. The technical problem is also concerned with finding a maximum heat exchanger. In fact, the catalyst is not supplied properly to the heat exchanger through an inclined conduit because of a quasi-absence of space for release of the fluidization gas from the catalyst in the exchanger, which means that the fluidization gas tends to rise in the conduit in the form of bubbles, therefore acting against flow of the catalyst.

The present invention aims to remedy the drawbacks mentioned hereinabove and to permit significantly improved results.

SUMMARY OF THE INVENTION

To be more precise, the invention relates to a process for the regeneration in fluidized bed of a catalyst contaminated with coke deposited thereon, wherein the catalyst to be regenerated and a gas containing oxygen are introduced into a first regeneration zone where it is regenerated, at least in part, under suitable conditions in dense bed, the gaseous effluents from the first regeneration operation are separated and are removed by their own means preferably in the upper part of the first regeneration zone, and the catalyst is drawn off, at least in part regenerated, from the first zone so as to be conveyed to the second regeneration zone which is separate from the first regeneration zone where it is regenerated at a temperature above that in the first regeneration zone, and the catalyst is separated from the fumes of the second regeneration operation which are removed at least in part, the process being characterised by the following steps:

a) A part, at least, of the catalyst contained in the second regeneration zone and also a part of the fumes are conveyed downwardly through an inclined conduit into an external heat exchange zone of appropriate height, said conduit connecting the dense bed of the second regeneration zone to the heat exchange zone and opening there at a junction point placed in such a way that the lower end of said heat exchange zone up to above said junction point defines a zone of catalyst in dense bed substantially level with the catalyst in the regeneration zone and a discharge zone of appropriate volume in said heat exchange zone above said dense bed as far as the upper end of the heat exchange zone, b) the catalyst is cooled in at least part of said zone in dense bed under suitable indirect heat exchange and fluidization conditions, in the presence of a fluidization gas which preferably contains oxygen, the catalyst circulating towards the bottom at counter-current to the direction of flow of the fluidization gas, c) the catalyst and fluidization gas and also any regeneration fumes in said volume of the discharge zone are separated, d) said gases and fumes from step c) are removed from the discharge zone, and they are conveyed into the diluted phase above the dense bed of the second regeneration zone; and e) the cooled catalyst is drawn off from the lower part of the heat exchange zone, and is recycled in the first regeneration zone.

The invention is advantageous in that it is very easy to use. By connecting the degassing line to the discharge zone for the fumes and fluidization gases of the catalyst in the upper part of the exchanger which is of adequate volume above the level of the dense bed, flow of the catalyst is promoted from the second regenerator around the bundle of exchange tubes. Therefore, its flow into the conduit which supplies the exchanger is promoted. Moreover, all the flow of catalyst which can be increased to satisfy the heat equilibrium conditions in the unit as a function of the severity of the charge passes through the exchanger and helps improve the heat exchange and thus control it.

According to a first variant, the cooled catalyst can be recycled by force of gravity either directly into the bed in dense phase in the first regeneration zone or directly in the diluted phase of the first regeneration zone.

According to a second variant, which enables the balance of pressures to be better satisfied, the cooled catalyst can be recycled in the dense phase of the first regeneration zone, advantageously above the fluidization member. In this case, the catalyst descends by force of gravity into a conduit which is connected at a Y-shaped or J-shaped junction. It then rises again, is accelerated by suitable means in the presence of a fluidization gas, as far as the dense phase of the catalyst. A valve disposed on the conveyance conduit is preferably beneath the level of the lower end of the first regeneration zone and permits manual or automatic control of the flow of catalyst circulating in the heat exchange zone. The velocity of the catalyst is from 1 to 2 m/s, for example, in the descending part of the conduit, and from 5 to 12 m/s in the ascending part. The rising gas of the catalyst usually assists its fluidization in the first regeneration zone, and if it contains oxygen, which it usually does, its regeneration is also assisted.

The catalyst which passes through the heat exchanger is usually cooled by 50° to 300° C.

According to one feature of the invention, the fluidization velocity in the exchanger is usually between 0.025 m/s and 1 m/s, advantageously between 0.05 and 0.5 m/s, and preferably between 0.1 and 0.4 m/s. Under these preferred conditions, a better heat exchange coefficient is observed. According to another feature, the fluidization velocity in the second regenerator is usually between 0.6 and 1.5 m/s, and advantageously between 0.8 and 1.2 m/s.

To permit satisfactory discharge of fluidization gas and catalyst regeneration fumes, an exchanger is usually selected which is of a height such that the available space for the discharge of fluidization gas and fumes corresponds to a height of between 0.1 and 5 m, and preferably between 1 and 2.5 m above the level of the dense bed in the second regeneration zone.

The gases and fumes can be removed from the discharge zone at a speed of between 2 and 15 m/s, advantageously between 5 and 8 m/s.

The diameter of the discharge tube is usually such that the loss of charge is restricted to 0.1 bar, for example. This corresponds to a ratio of the diameter of the tubes for intake of the catalyst and removal of the gases which is usually less than or equal to 10, for example between 3 and 6.

According to one advantageous embodiment, almost the entire indirect heat exchange process can be effected below the junction point of the inclined conduit for intake of hot catalyst into the heat exchanger. Under these conditions, the heat exchange is maximized since the entire surface area of the exchanger is in contact with all of the catalyst circulating therein.

According to another embodiment, a part of the cooling tubes in the exchanger can pass beyond the junction point, so that they almost reach the upper level of the dense phase.

The flow of catalyst passing through the exchanger, and thus also the regulation of heat, are usually controlled by a valve at the outlet from the exchanger in a conduit which is substantially elongate and which recycles the cooled catalyst in the first regenerator. This valve is usually under the control of suitable control means which are connected to a temperature probe situated either in the dense bed or in the fluidized bed of the second generator and which usually makes a continuous comparison between the temperature signal and a reference signal which has been determined beforehand as a function of the regeneration parameters and type of the charge.

These control means can possibly be under the control of a valve which controls the flow of fluidization air in the first regenerator.

According to another embodiment, it is also possible to measure the temperature for first regeneration by using a temperature probe which is preferably immersed in the dense bed, and to use said control means to act upon an opening valve for the catalyst from the outlet of tie exchanger and also possibly the control valve for the flow of air in the first regenerator.

The invention also relates to an apparatus for regeneration in fluidized bed of a catalyst contaminated with coke, comprising a first regenerator (1) which comprises intake means (2) for a used up catalyst, fluidization means (5) and regeneration means for the catalyst using a gas containing oxygen, said means operating in fluidized bed in dense phase (3), first separation means (6) for the regeneration fumes of the catalyst which has been partly regenerated and first removal means (7) for said fumes, means (10) for conveying said catalyst from the first regenerator to a second regenerator (9) defined hereinafter, the second regenerator comprising means for fluidization and for regeneration (12) of the catalyst which has been regenerated at least in part by a gas containing oxygen, said means operating in fluidized bed in dense phase (19) as far as an appropriate level (19*a*), second separation means (17) for the regeneration fumes from the regenerated catalyst and second means for removal (18) of said fumes separated from the first removal means, said apparatus being characterised in that it comprises, in combination:

an external, vertical, elongate heat exchanger (21) of suitable height which receives the hot catalyst and possibly a part or the fumes through an inclined conduit (20) connecting said dense bed of the second regenerator to the exchanger, and which cools it as it circulates through the exchanger in a downward direction, said exchanger comprising means (24) for fluidization of the catalyst using a gas at the lower end, the means forming a dense bed at an appropriate level (19*b*), said inclined conduit (20) opening into the exchanger (21) at a junction point disposed beneath the level (19*a*) of the dense bed of the second regenerator (9) at a spacing from the upper end (26) thereof, in such a way that separation is possible of possible regeneration fumes and fluidization gas from the catalyst in the upper part (27) of the exchanger or discharge zone disposed above the level of the dense bed in the exchanger, means (28) for removal of the fumes and fluidization gas from the discharge zone at the upper part of the exchanger, the means being connected to the second regenerator (9) at a point above the level (19*a*) of the dense bed of the catalyst, in said regenerator; and withdrawal and recycling means (34, 30) for circulating the cooled catalyst from the lower end of the exchanger to the first regenerator.

The junction point of the heat exchanger with the inclined conduit can be disposed at a spacing away from the upper end of the exchanger between a quarter and a half of the total height, preferably between a quarter and a third.

The amount of catalyst cooled by the exchanger is usually less than 150% by weight of the catalyst circulating in the first regeneration zone. It has been noted that an excellent regeneration rate is obtained with an amount of cooled catalyst of between 15 and 50% by weight.

The heat exchangers can be of the per se known kind, such as those described in the patent FR 2628432, and they are usually in the form of bundles of tubes for indirect heat exchange with the catalyst (coiled tubes, U-shaped tubes, pin-tubes or bayonet-type tubes). The catalyst can circulate either inside or outside. The wall of the heat exchanger can possibly comprise a tube-membrane surface. The cooling fluid which circulates in the exchanger can be air, water, water vapour or mixtures of these fluids.

The regenerated catalyst according to the invention is also of the conventional kind, such as silica-aluminas of the zeolite kind which advantageously have a grain size of 30 to 100 micrometers.

BRIEF DESCRIPTION OF FIGURE

The invention will be better understood in the light of the attached FIGURE, which is a schematic elevation illustrating the process and apparatus.

DETAILED DESCRIPTION OF FIGURE

A first regenerator 1 coming from a catalytic cracking unit receives a zeolite catalyst which comes from a stripper separator, not shown, and coke has been deposited on this catalyst during the catalytic cracking reaction. The line opens into the catalytic bed at a suitable place, preferably in the diluted phase disposed above the dense fluidized bed 3. A regeneration gas containing oxygen is supplied via a line 4 into a fluidization member 5 such as a grating, a ring or a distribution pipe at the base of the regenerator, and permits counter-current dense bed fluidization of the catalyst and continuous combustion of about 50 to 90% of the coke. The regeneration fumes and the catalyst which are entrained are separated in cyclones 6, and the regeneration fumes containing major combustion products in the form of carbon monoxide, carbon dioxide and water vapour are removed via the line 7 towards the burner.

The temperature of the fluidized bed 3 is measured using a probe 8. When this temperature decreases below a recommended value T1, owing to the introduction of relatively cold catalyst introduced through the lines 34 as will be seen hereinafter, the flow of oxidizing fluid (fluidization fluid) supplied to the fluidization member 5 and controlled by a control valve 33 on the line 4 is increased until the temperature measured at 8 meets the recommended value.

The catalyst particles which have been partially regenerated are then conveyed to a second regenerator 9 placed above the first regenerator 1, via the conduit 10 supplied with air by the line 11. At the bottom of the second regenerator there is a diffuser 12 which is supplied with air by the line 13. The catalyst which has been partially regenerated undergoes combustion in the dense bed 19, the upper part of which defines a level **19*b*** at a suitable height, depending on the aeration provided.

A part of the particles of the regenerated catalyst is removed laterally into a plugged chamber 14. In this chamber, fluidization of the particles is usually controlled by an annular diffuser 15 which is supplied with fluidization gas such as air or inert gas via a line 16. From the chamber 14, the particles of regenerated catalyst are recycled by a conduit 35 for supplying a riser, not shown, with an amount determined by opening or closure of a valve. At the upper part of the second regenerator, the combustion gases are separated from the catalyst particles by the external cyclones 17 and are removed via the line 18, separate from the line 7 for removal of the fumes of the first regeneration.

A part of the hot catalyst and a part of the fumes at a temperature of between 600° and 850° C. are removed from the dense bed 19 of the second regenerator at a point situated above the air injection member 12 and are supplied by force of gravity, by virtue of a downwardly inclined conduit 20, which may be at an angle of 30° to 60° relative to the axis of the exchanger, into a heat exchanger 21 for indirect heat exchange. The exchanger is vertical, elongate, cylindrical and contains an exchange bundle comprising coiled tubes 22, for example, wherein a suitable fluid such as pressurized water circulates which is supplied by a line **23*a*. The water vapour from this heat exchange is recovered by line 23*b*. The bundle of tubes is advantageously disposed beneath the inclined conduit in such a way that the catalyst which is drawn off circulates through the bundle, from the top to the bottom. At the lower end of the exchanger, a fluidization means 24 (ring or grating) introduces air which is supplied by a line 25** at counter-currently to the direction of flow of the catalyst, and keeps the catalyst in the dense bed through the bundle of tubes.

The conduit 20 for supply of the hot catalyst, which conduit is inclined at an angle of 30° to 60° relative to the axis of the exchanger opens into this exchanger at a junction point situated beneath the level 19*a* of the dense bed of the second regenerator, for example, at a point situated at a distance away from the upper end 26 of the exchanger between one quarter and one third of its height, in such a way that in the upper part of the exchanger the catalyst in dense bed reaches a suitable level 19*b* which is a function of the respective fluidization speeds in the second regenerator and the heat exchanger and thus of the respective volume masses. Thus, a slight difference can occur between the levels of catalyst in the regenerator and exchanger.

The height of the exchanger is selected in such a way that in relation to the level in the regenerator, a free zone known as the discharge zone 27 of 1 to 2.5 m is formed in the exchanger to enable the fluidization gas to be separated from any possible fumes due to regeneration of the catalyst. A degassing line 28 removes the fumes and the gases from the diluted phase at the upper end of the exchanger towards the diluted fluidized phase 29 above the dense fluidized bed of the second regenerator. The diameter thereof is selected in such a way that the ratio of the diameter of the degassing line to that of the conduit 20 for intake of the catalyst is between 3 and 6. The exit speed of the gases is usually between 2 and 15 m/s.

The drawing off and recycling means 34 comprise a substantially vertical conduit 34*a* in which the catalyst flows by the force of gravity, the conduit being connected at a Y-shaped or J-shaped junction 34*b* situated below the first regenerator. The catalyst is conveyed via a lift 36 which is connected at the junction 34*b* which accelerates the catalyst due to the fluidization air 37 in the conduit 34*c*, and recycles it in the dense phase of the first regenerator, preferably above the fluidization member 5.

At the exit from the exchanger 21, the valve 30 which may be in the form of a slide valve, and which is disposed beneath the lower end of the first regenerator and upstream of the "lift" permits control of the flow of catalyst which is being conveyed from one regenerator to the other as soon as the temperature of the regenerated catalyst exceeds the required recommended value.

The flow of catalyst which passes through the heat exchanger is adjusted to keep the temperature prevailing in the second regenerator, and thus finally the intake temperature into the reaction zone (riser) at a recommended temperature which is suitable for the cracked charge in the unit.

Thermal control of the regeneration operation is achieved by the combination of the following components:

Control and regulatory means 31 are connected to the valve 30 disposed on the conduit 17 for removal of the catalyst from the exchanger. These means are also connected to a temperature probe 32 disposed in the dense bed of the second regenerator 9. When the signal emitted by the probe reaches a value which is greater than the recommended value selected beforehand as a function of the regeneration parameters, and which value has been stored by the regulatory means, these latter send a signal to the valve 30 which increases the discharge flow of the catalyst and thus increases the intake flow of catalyst into the exchanger. This increase in flow causes a temperature decrease in the first regeneration operation which is registered by the temperature probe 8, and this temperature decrease is then compensated for by means 31 which increase the supply of oxygen by virtue of a valve 33 on the line 4 which supplies the fluidization injector of the first regenerator. A larger amount of coke can then be burned there.

On the other hand, when the signal emitted by the probe 32 reaches a value which is less than the recommended value, the valve 30 is partly closed in such a way that the heat exchange is reduced. In parallel, the consumption of oxygen decreases in the first regenerator, and therefore less coke is burned which helps increase the temperature of the catalyst in the second regenerator. As a result of this, the temperature is kept substantially constant within the desired range of values.

By way of example, the following example is given:

| | |
|---|---|
| Flow of catalyst in the exchanger | 5 88 000 kg/h |
| Temperature of dense bed in second regenerator | 720° C. |
| Outlet temperature from exchanger | 550° C. |
| Amount of fluidization air in exchanger | 2 200 kg/h |
| Height of exchange bundle (coils) | 5.8 m |
| Height of discharge zone | 2.5 m |
| Amount of heat exchanged | $125 \times 10^6$ KJ/h |
| Flow of vapour generated | 75 000 kg/h |
| Temperature of vapour | 258° C. |
| Vapour pressure | 4.5 MPa |

We claim:

1. In an apparatus for regeneration of a fluidized bed of a catalyst contaminated with coke, said apparatus comprising a first regenerator (1) which comprises an enclosure, intake means (2) for spent catalyst, fluidization means (5) and regeneration means for the catalyst using a gas containing oxygen, first separation means (6) in communication with said enclosure of said first regenerator for the regeneration fumes of the catalyst which has been partly regenerated and first removal means (7) for said fumes, a second regenerator superposed over and distinct from the first regenerator, transfer means (10) for said catalyst from the first regenerator to said superposed second regenerator (9) distinct from the first regenerator, the second regenerator comprising an enclosure, means for fluidization and for regeneration (12) of the catalyst which has been regenerated at least in part by a gas containing oxygen, second separation means (17) in communication with the second regenerator for the regeneration fumes from the regenerated catalyst and second means for removal (18) of said fumes separated by the second separation means, the improvement which comprises:

an external, vertical, elongate heat exchanger (21) having an upper and a lower end, for receiving the hot regenerated catalyst, a valve-less inclined conduit (20) directly connecting said second regenerator to the exchanger (21), said heat exchanger having means (22) therein for cooling the hot catalyst circulating downwardly through the exchanger, said exchanger comprising means (24) for fluidization of the catalyst using a gas at the lower end, said inclined conduit (20) opening into the exchanger (21) at a junction point disposed between the upper end and the lower end of the second regenerator (9) and at a spacing from the upper end (26) thereof in such a way that separation is possible of any regeneration fumes and fluidization gas from the catalyst in the upper part (27) of the exchanger; wherein the height of the catalyst in the heat exchanger is maintained substantially the same as the height of the catalyst in the second regenerator;

means (28) for removal of the fumes and fluidization gas from a discharge zone at the upper part of the exchanger, the means being connected to the second regenerator (9) at a point in the upper part of the of said second regenerator; and withdrawal and recycling means for circulating the cooled catalyst from the lower end of the exchanger to the first regenerator, said withdrawal and recycling means comprising a lift (36) for lifting the catalyst from below the first regenerator directly into the first regenerator.

2. An apparatus according to claim 1, wherein the junction point on the exchanger is disposed at a spacing from the upper end of the exchanger between a quarter and a half of the total height of the exchanger.

3. An apparatus according to claim 1, wherein the exchanger (21) comprises a heat exchange bundle (22) disposed in the part of the exchanger disposed beneath the junction point.

4. An apparatus according to claim 1, wherein the withdrawal and recycling means comprise a control valve (30) for flow of the catalyst, the valve being disposed beneath the lower end of the exchanger.

5. An apparatus according to claim 1, wherein the means for fluidization and regeneration of the first regenerator comprise a gas distributor means, and wherein the withdrawal and recycling means (34) open into the first regenerator above the fluidization member.

6. An apparatus according to claim 1, wherein the withdrawal and recycling means comprise a conduit (34*a*) and the control valve connecting the bottom end of the exchanger to a junction having a Y-shape or J-shape disposed beneath the level of the first regenerator, said junction comprising conduit means (34*c*) for raising the catalyst into the first regenerator, and a source of fluidization air (37) for accelerating catalyst (through conduit means (34*c*) into the first regenerator, said junction being separate and distinct from said intake means (2).

7. An apparatus according to claim 1, comprising means for controlling and regulating the temperature, the means comprising a control device (31) connected to a temperature probe (32) in the second regenerator (9) which is under the control of said control valve (30), said controller optionally being connected to a temperature probe (8) disposed in the first regenerator (1) and being under the control of a valve (33) for controlling the flow of said fluidization gas in the first regenerator (1).

8. An apparatus according to claim 1, wherein the junction point on the exchanger is disposed at a spacing from the upper end of the exchanger between a quarter and a third of the height.

9. An apparatus according to claim 1, wherein a dense bed of catalyst is included in the first regenerator (1), the second regenerator (9), and the heat exchanger (21), and an open space is included above the level of each of the dense beds in each of the regenerators and the exchanger, said dense bed in said second regenerator being in communication with said dense bed in said exchanger through said inclined conduit (20), separating means (6) and (17) being in communication with said first and second regenerators respectively, and means (28) for removal of the fumes and fluidization gas from the exchanger being in communication with the open space above the level of the dense bed in the exchanger, and said upper end (26) of said vertical elongate heat exchanger (21) being disposed at a level above the dense bed in the second regenerator.

10. An apparatus according to claim 1, said withdrawal and recycling means comprising a conduit supplied with a valve (30) to adjust the flow of catalyst.

11. An apparatus according to claim 10, wherein said valve (30) is responsive to the temperature of regenerated catalyst.

12. An apparatus according to claim 1, wherein the withdrawal and recycling means comprise a conduit (34*a*) and conduit means (34*c*) connected to form a junction having a Y-shape or J-shape disposed beneath the level of the first regenerator, and a source of fluidization air (37) for accelerating catalyst through conduit means (34*c*) into the first regenerator.

13. An apparatus according to claim 1, wherein said recycling means (36) comprises a conduit (34*c*) entering the bottom of the first regenerator in a vertical direction.

14. The apparatus of claim 1, wherein the height of the upper part (27) of the heat exchanger above the catalyst is between 0.1 and 5.0 meters.

15. The apparatus of claim 1, wherein the ratio of the diameter of the inclined conduit (20) opening into the exchanger to the means (28) for removal of the fumes and fluidization gas from the discharge zone is less than or equal to 10.

16. The apparatus of claim 1, wherein the ratio of the diameter of the inclined conduit (20) opening into the exchanger to the means (28) for removal of the fumes and fluidization gas from the discharge zone is between 3 and 6.

17. The apparatus of claim 1, wherein the heat exchanger (21) has vertical cooling tubes extending above the junction point.

* * * * *